US009285733B2

(12) United States Patent
Yasuda

(10) Patent No.: US 9,285,733 B2
(45) Date of Patent: Mar. 15, 2016

(54) FIXING DEVICE AND IMAGE FORMING APPARATUS

(71) Applicant: Brother Kogyo Kabushiki Kaisha, Nagoya-shi, Aichi-ken (JP)

(72) Inventor: Masaki Yasuda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 20 days.

(21) Appl. No.: 14/032,345

(22) Filed: Sep. 20, 2013

(65) Prior Publication Data

US 2014/0086644 A1 Mar. 27, 2014

(30) Foreign Application Priority Data

Sep. 21, 2012 (JP) ..... 2012-207906

(51) Int. Cl.
*G03G 15/20* (2006.01)

(52) U.S. Cl.
CPC ..... *G03G 15/2053* (2013.01); *G03G 15/2028* (2013.01); *G03G 2215/0141* (2013.01)

(58) Field of Classification Search
CPC ..... G03G 15/2028; G03G 2221/00
USPC ..... 399/322, 400
See application file for complete search history.

(56) References Cited

U.S. PATENT DOCUMENTS 4,369,729 A * 1/1983 Shigenobu et al. ..... 118/60
5,225,879 A * 7/1993 Hayashida ..... 399/315
6,070,049 A * 5/2000 Hayashida ..... 399/400
2002/0131801 A1 9/2002 Tomatsu
2005/0207802 A1* 9/2005 Izumi et al. ..... 399/316
2007/0098472 A1* 5/2007 Saeki et al. ..... 399/400
2012/0230746 A1* 9/2012 Namisaki et al. ..... 399/400

FOREIGN PATENT DOCUMENTS

JP H01-154185 A 6/1989
JP 06324587 A * 11/1994 ..... G03G 15/20
JP 2002-278239 A 9/2002
JP 2006119422 A * 5/2006
JP 2010250054 A * 11/2010

OTHER PUBLICATIONS

Machine translation of Watanabe 2006.*

* cited by examiner

*Primary Examiner* — David Gray
*Assistant Examiner* — Sevan A Aydin
(74) *Attorney, Agent, or Firm* — Banner & Witcoff, Ltd.

(57) ABSTRACT

A fixing device may include a first fixing member, and a second fixing member, and may be configured to heat-fix a developer image on a recording sheet at a fixing nip formed between the first fixing member and the second fixing member. The fixing device may further include a charge-removing member arranged upstream of the fixing nip in a conveyance direction of the recording sheet and in a vicinity of a conveyance path of the recording sheet conveyed towards the fixing nip, and including a main body part and an end edge positioned at an edge of the main body part, and an insulating member arranged between the conveyance path and at least the entire end edge of the charge-removing member.

21 Claims, 7 Drawing Sheets

FIXING DEVICE AND IMAGE FORMING APPARATUS

CROSS-REFERENCE TO RELATED APPLICATION

This application claims priority from Japanese Patent Application No. 2012-207906, filed on Sep. 21, 2012, the entire subject matter of which is incorporated herein by reference.

TECHNICAL FIELD

Aspects of the present invention relate to a fixing device for heat-fixing a developer image on a recording sheet and an image forming apparatus including the fixing device.

BACKGROUND

There has been known an image forming apparatus which includes a charge-removing member for removing charge from a recording sheet before the recording sheet having a developer image transferred thereon enters a fixing nip of a fixing device (refer to JP-A-H1-154185). In this image forming apparatus, a tip end of the charge-removing member is arranged on a conveyance path of the recording sheet, and the recording sheet contacts the tip end of the charge-removing member, so that charge on the recording sheet is removed.

However, when the recording sheet contacts the tip end of the charge-removing member in the above image forming apparatus, charges collected on the recording sheet are rapidly removed. As a result, the developer image (charged developer) on the recording sheet may be disordered, so that an image quality may be deteriorated.

SUMMARY

Accordingly, an aspect of the present invention provides a technique of improving image quality by suppressing charges collected on a recording sheet from being rapidly removed.

According to an illustrative embodiment of the present invention, there may be provided a fixing device including a first fixing member and a second fixing member and configured to heat-fix a developer image on a recording sheet at a fixing nip formed between the first fixing member and the second fixing member. The fixing device may further include a charge-removing member and an insulating member. The charge-removing member may be arranged upstream of the fixing nip in a conveyance direction of the recording sheet and in a vicinity of a conveyance path of the recording sheet conveyed towards the fixing nip, and includes a main body part and an end edge positioned at an edge of the main body part. The insulating member may be arranged between the conveyance path and at least the entire end edge of the charge-removing member.

According to another illustrative embodiment of the present invention, there may be provided an image forming apparatus including a photosensitive member, a transferring member and the above fixing device. The photosensitive member may have a surface, on which a developer image is configured to be formed. The transferring member may be arranged to face the photosensitive member and configured to transfer the developer image formed on the surface of the photosensitive member to a recording sheet at a transfer nip formed between the photosensitive member and the transferring member.

According to another illustrative embodiment of the present invention, there may be provided an image forming apparatus comprising: a photosensitive drum; a fuser for fusing developer to paper at a nip comprising a guide, the guide defining a path where paper passes toward the nip; and a metal frame, the guide being disposed between an entire edge of the metal frame and the path.

According to the above configuration, since the insulating member may be arranged between the conveyance path and the entire end edge of the charge-removing member, which is apt to attract charges, the charges collected on the recording sheet may be not rapidly removed at the charge-removing member, so that an image quality can be improved.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, an illustrative embodiment of the invention will be specifically described with reference to the drawings. Meanwhile, in the below descriptions, a direction is described based on a user who uses a color printer 1 (an example of an image forming apparatus). That is, the left side in FIG. 1 is referred to as a 'front', the right side is referred to as a 'rear', the front side is referred to as a 'right' and the back side is referred to as a 'left.' The upper and lower directions in FIG. 1 are referred to as an 'upper-lower.'

<Schematic Configuration of Color Printer>

Figure 1:
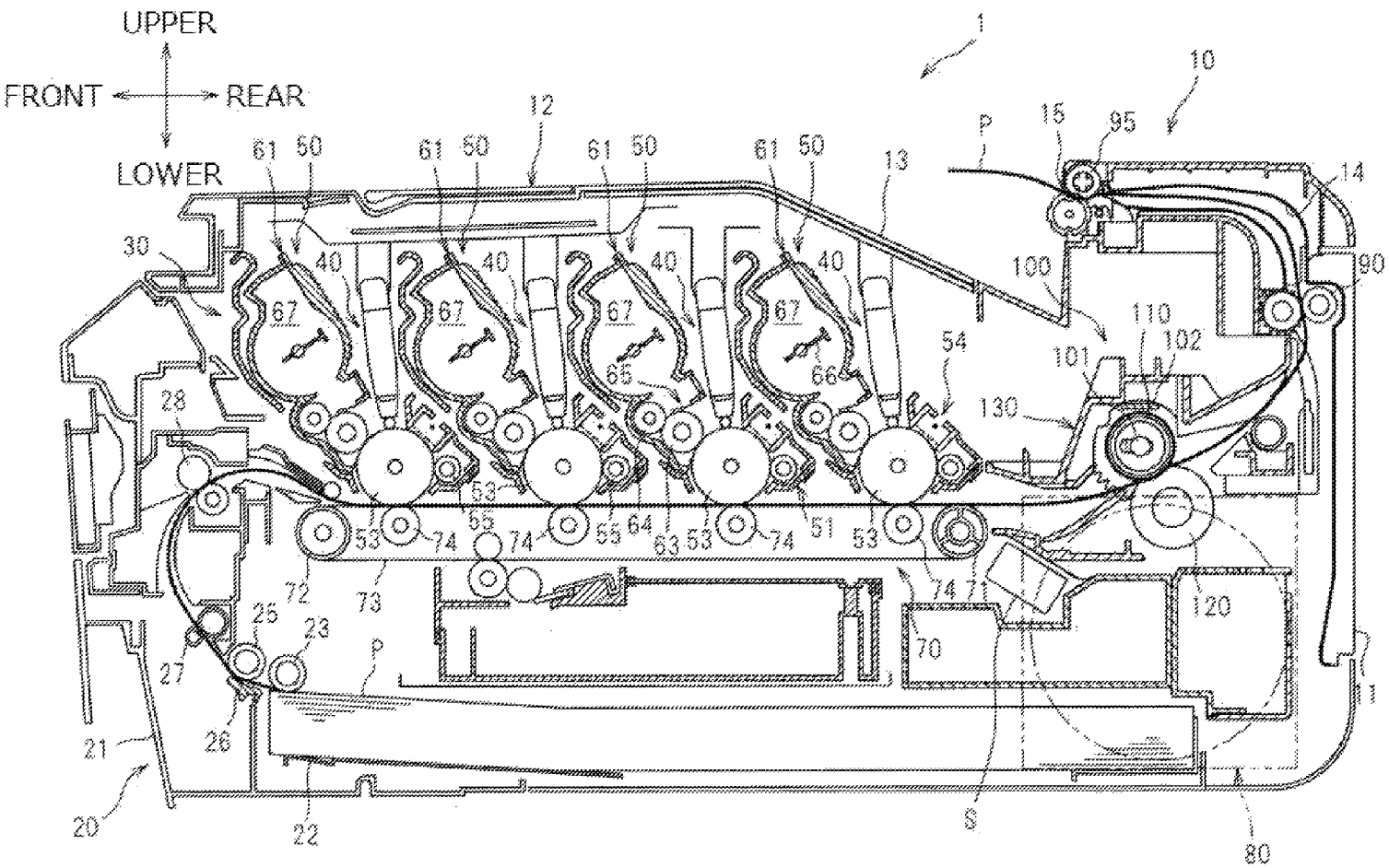
FIG. 1 is a sectional view showing a color printer according to an illustrative embodiment of the invention.

As shown in FIG. 1, the color printer 1 mainly includes, in an apparatus body 10, a feeder unit 20 and an image forming unit 30. The apparatus body 10 is provided with an upper cover 12 at its upper side. The upper cover 12 is configured to be openable/closeable in an upper-lower direction about a rear side serving as a rotation center.

The feeder unit 20 is provided in the apparatus body 10 at a lower part. The feeder unit 20 mainly includes a sheet feeding tray 21 which accommodates therein sheets P (an example of a recording sheet), a sheet pressing plate 22, a feeder roller 23, a separation roller 25, a separation pad 26, paper powder pickup rollers 27 and registration rollers 28. The sheets P in the sheet feeding tray 21 are inclined towards the feeder roller 23 by the sheet pressing plate 22 and sent by the feeder roller 23. The sent sheets P are separated one by one by the separation roller 25 and the separation pad 26, which is then fed to the image forming unit 30 by the registration rollers 28 after paper powders thereof are collected by the paper powder pickup rollers 27.

The image forming unit 30 mainly includes four LED units 40, four process cartridges 50, a transfer unit 70 (an example of a transferring member) and a fixing device 100.

The LED unit 40 is arranged above a photosensitive drum 53 (an example of a photosensitive member) and includes a plurality of LEDs (light emitting diodes) (not shown) provided at a lower end thereof and arranged in a left-right direction. The LED unit 40 is configured to expose a surface of the photosensitive drum 53 as the LEDs turn on and off on the basis of image data. Also, the LED unit 40 is held at the upper cover 12 and is spaced from the photosensitive drum 53 as the upper cover 12 is opened.

The process cartridges 50 are arranged side by side in a front-rear direction between the upper cover 12 and the sheet feeding tray 21. The process cartridges 50 are configured to be replaced with respect to the apparatus body 10 at a state where the upper cover 12 is opened. Each process cartridge 50 includes a photosensitive cartridge 51, and a developing cartridge 61 which can be attached to and detached from the photosensitive cartridge 51.

Each photosensitive cartridge 51 mainly includes the photosensitive drum 53, a charger 54, and a collection roller 55. The collection roller 55 is a roller for collecting transfer remaining toner attached on the photosensitive drum 53. Each developing cartridge 61 mainly includes a developing roller 63, a supply roller 64, a layer thickness regulation blade 65, an agitator 66, and an accommodation unit 67 which accommodates therein positively-charageable toner (an example of developer).

The transfer unit 70 is provided between the sheet feeding tray 21 and the process cartridges 50 and mainly includes a driving roller 71, a driven roller 72, an endless conveyance belt 73, and four transfer rollers 74. The conveyance belt 73 is provided in a tensioned state between the driving roller 71 and the driven roller 72, an outer surface thereof is arranged to face the photosensitive drums 53, and the transfer rollers 74 are arranged to sandwich the conveyance belt 73 at an inside of the belt between the transfer rollers 74 and the photosensitive drums 53.

A sensor S which detects toner (test pattern) transferred onto the conveyance belt 73 is arranged at an oblique rear-lower side of the conveyance belt 73. Here, the conveyance belt 73 is configured such that the toner is not transferred thereto from the photosensitive drums 53 at normal printing control but is transferred thereto from the photosensitive drums 53 when performing a printing test (described later). In the meantime, as the sensor S, a light reflection-type sensor having combined a light emitting device and a light receiving device and the like may be used.

The fixing device 100 is provided at the rear (at a downstream side in the conveyance direction of the sheet P) of the process cartridges 50 and the transfer unit 70. The fixing device 100 mainly includes a halogen lamp 101, a heating roller 110 (an example of a first fixing member) which is heated by the halogen lamp 101, and a pressing roller 120 (an example of a second fixing member) which forms a fixing nip between the pressing roller 120 and the heating roller 110. The heating roller 110 and the pressing roller 120 are both formed to be long in the left-right direction. The fixing device 100 further includes a non-contact thermistor 102 configured to detect a temperature of the heating roller 110. The thermistor 102 is arranged above the heating roller 110 to face the heating roller 110 at an interval from an upper surface of the heating roller 110.

Figure 2:
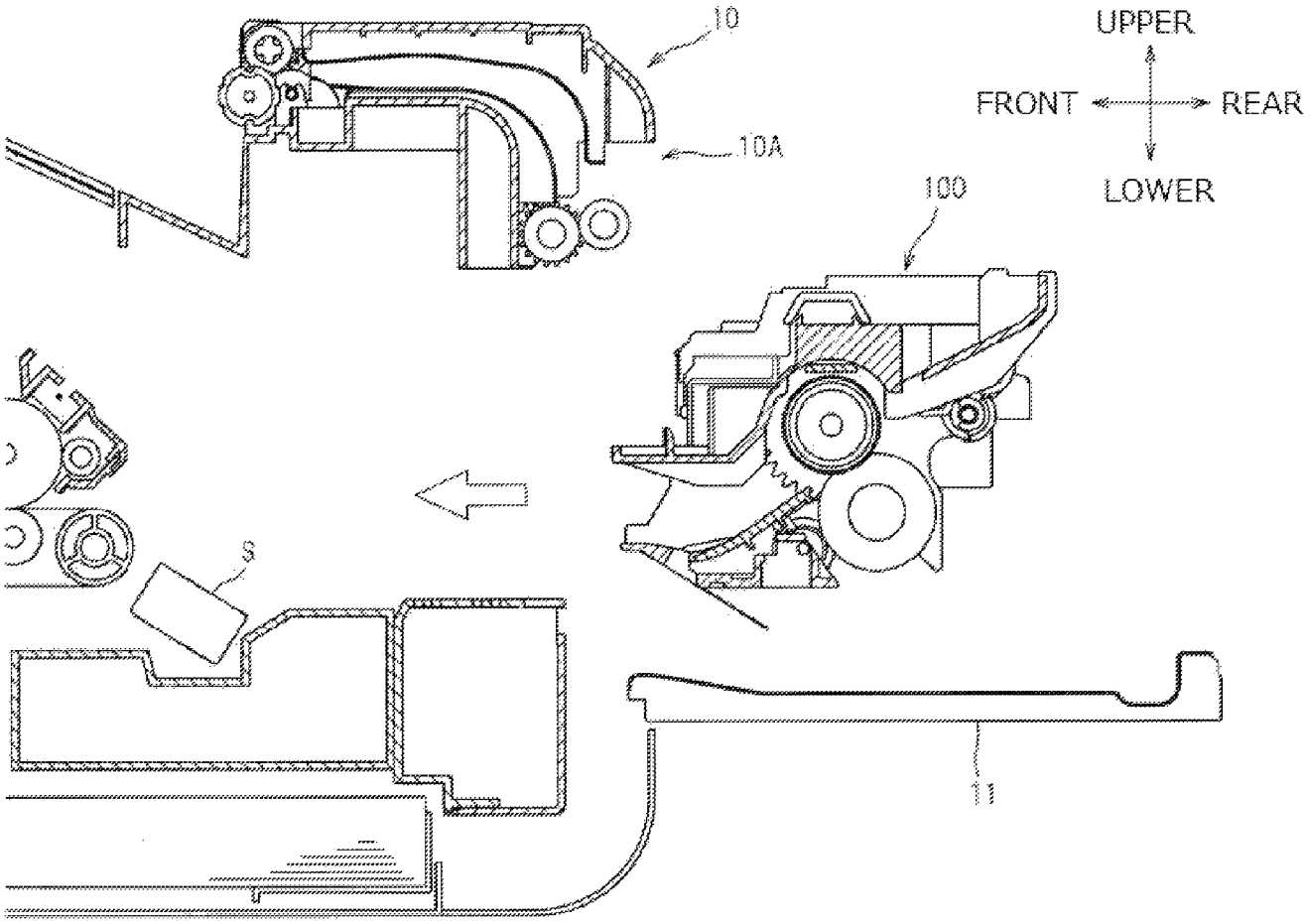
FIG. 2 is a sectional view showing a state where a fixing device is being mounted to an apparatus body.

As shown in FIG. 2, the fixing device 100 is removably mounted to the apparatus body 10 through an opening 10A which is opened and closed by a rear cover 11 rotatably provided at the rear of the apparatus body 10. Specifically, the fixing device 100 is mounted in a front-side direction (an arrow direction in FIG. 2) and is removed in a rear-side direction (an example of a second direction) with respect to the apparatus body 10. The fixing device 100 will be specifically described later.

An exhaust fan 80 which exhausts air in the apparatus body 10 to an outside is provided below the halogen lamp 101 of the fixing device 100. Specifically, the exhaust fan 80 is configured to suction air around the sensor S.

In the image forming unit 30, the surfaces of the photosensitive drums 53 are uniformly charged by the chargers 54 and are then exposed by the LED units 40, so that electrostatic latent images based on the image data are formed on the surfaces of the photosensitive drums 53. The toners in the accommodation units 67 are stirred by the agitators 63 and supplied to the developing rollers 63, to which developing biases are applied, via the supply rollers 64. Then, the toners are introduced between the developing rollers 63 and the layer thickness regulation blades 65, respectively, so that the toners are carried on the developing rollers 63 as thin layers having a predetermined thickness. Then, when the developing rollers 63 are contacted to the photosensitive drums 53, the toners are supplied to the photosensitive drums 53 from the developing rollers 63, respectively, so that the electrostatic latent images become visible and toner images are formed on the surfaces of the photosensitive drums 53, as developer images, respectively.

The sheet P fed to the image forming unit 30 is conveyed to transfer nips formed between the photosensitive drums 53 and the conveyance belt 73, so that the toner images formed on the surfaces of the photosensitive drums 53 are transferred onto the sheet P in the transfer nips. The sheet P having the toner images formed thereon is conveyed to the fixing nip formed between the heating roller 110 and the pressing roller 120, so that the toner images are heat-fixed on the sheet P in the fixing nip. Thereby, an image is formed on the sheet P.

After that, the sheet P is conveyed along a sheet discharge path 14, is caused to pass through a sheet discharge port 15 of the apparatus body 10 and is then discharged onto a sheet discharge tray 13 from the apparatus body 10 by conveyance rollers 90 and discharge rollers 95.

When performing a printing test to determine whether a printing is appropriately made by the image forming unit 30 at initial starting, for example, a test pattern (toner) is printed from the photosensitive drums 53 onto the conveyance belt 73, and the test pattern on the conveyance belt 73 is detected by the sensor S.

<Detailed Structure Around Fixing Device 100>

Figure 3A:
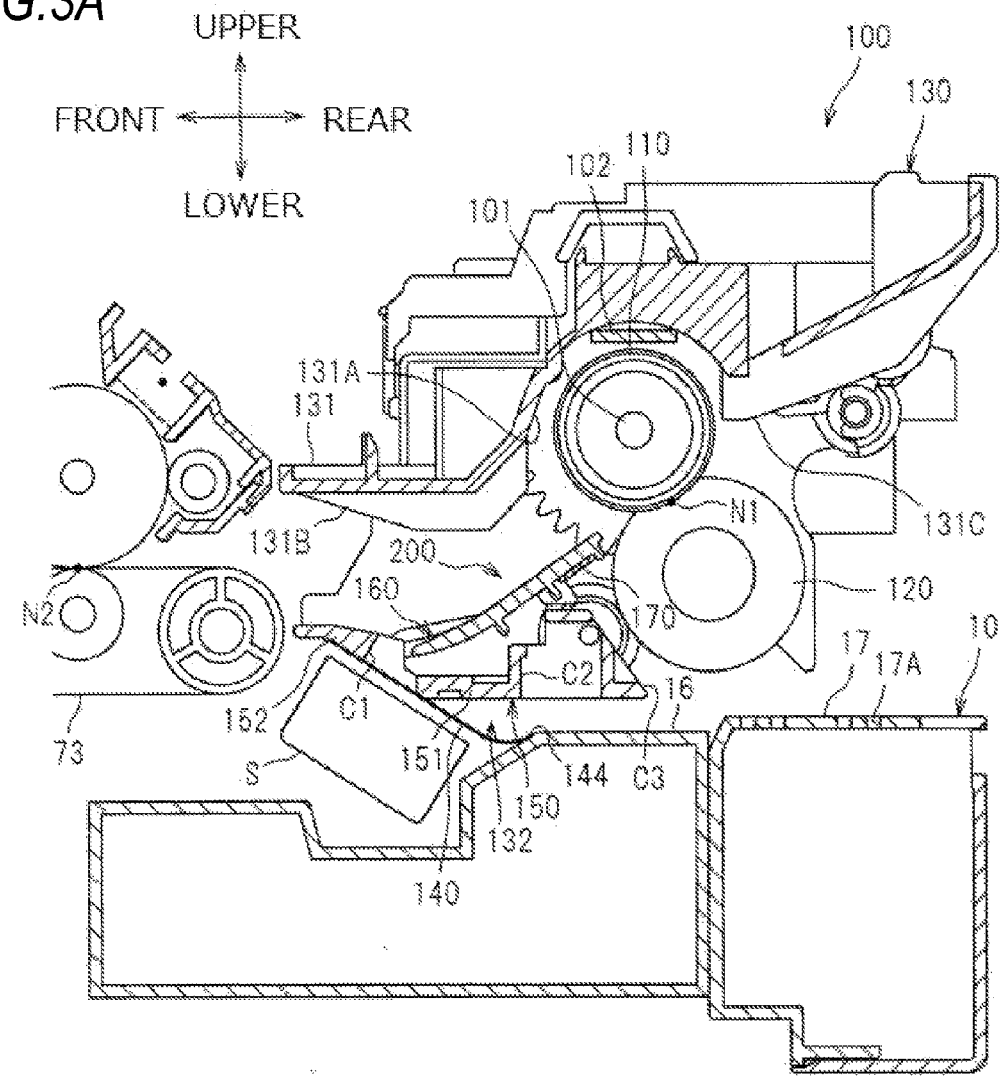
FIG. 3A is a sectional view showing a structure around the fixing device.

As shown in FIG. 3A, the fixing device 100 further includes a housing 130 which accommodates therein the halogen lamp 101 and the heating roller 110, in addition to the halogen lamp 101, the heating roller 110 and the pressing roller 120. The housing 130 includes an upper frame 131 and a lower frame 132.

The upper frame 131 has a recess portion 131A, which is recessed upwards and has a substantially U-shaped section. The recess portion 131A accommodates an upper half part of the heating roller 110. An upstream-side guide part 131B for forming a conveyance path upstream of the fixing nip N1 in the conveyance direction is provided at the front of the recess portion 131A and a downstream-side guide part 131C for forming a conveyance path downstream of the fixing nip N1 in the conveyance direction is provided at the rear of the recess portion 131A.

The lower frame 132 is provided below the upstream-side guide part 131B and there is no frame below the downstream-side guide part 131C. Thereby, heated air in the fixing device 100 is basically suctioned from the rear by the exhaust fan 80.

However, as in this illustrative embodiment, when the lower frame 132 is formed with holes C1, C2 (described later), or a passage C3 between the housing 130 (a rear end portion of an outer member 150 and a rear end portion of a lower guide member 160; described later) and the pressing roller 120, the heated air in the fixing device 100 may flow towards the sensor S through the holes C1, C2 and passage C3. Thus, in this illustrative embodiment, a film 140 which is arranged to cover the sensor S, when seen from the holes C1, C2 and passage C3, is provided at a position between the sensor S and holes C1, C2 or passage C3.

Thereby, even when the heat in the fixing device 100 intends to flow towards the sensor S through the holes C1, C2 and passage C3, the heated air is blocked by the film 140. Therefore, it is possible to suppress the sensor S from being heated due to the heated air, thereby improving an image quality.

In the below, the lower frame 132 and the film 140 will be specifically described with reference to FIGS. 4 to 6.

Figure 4:
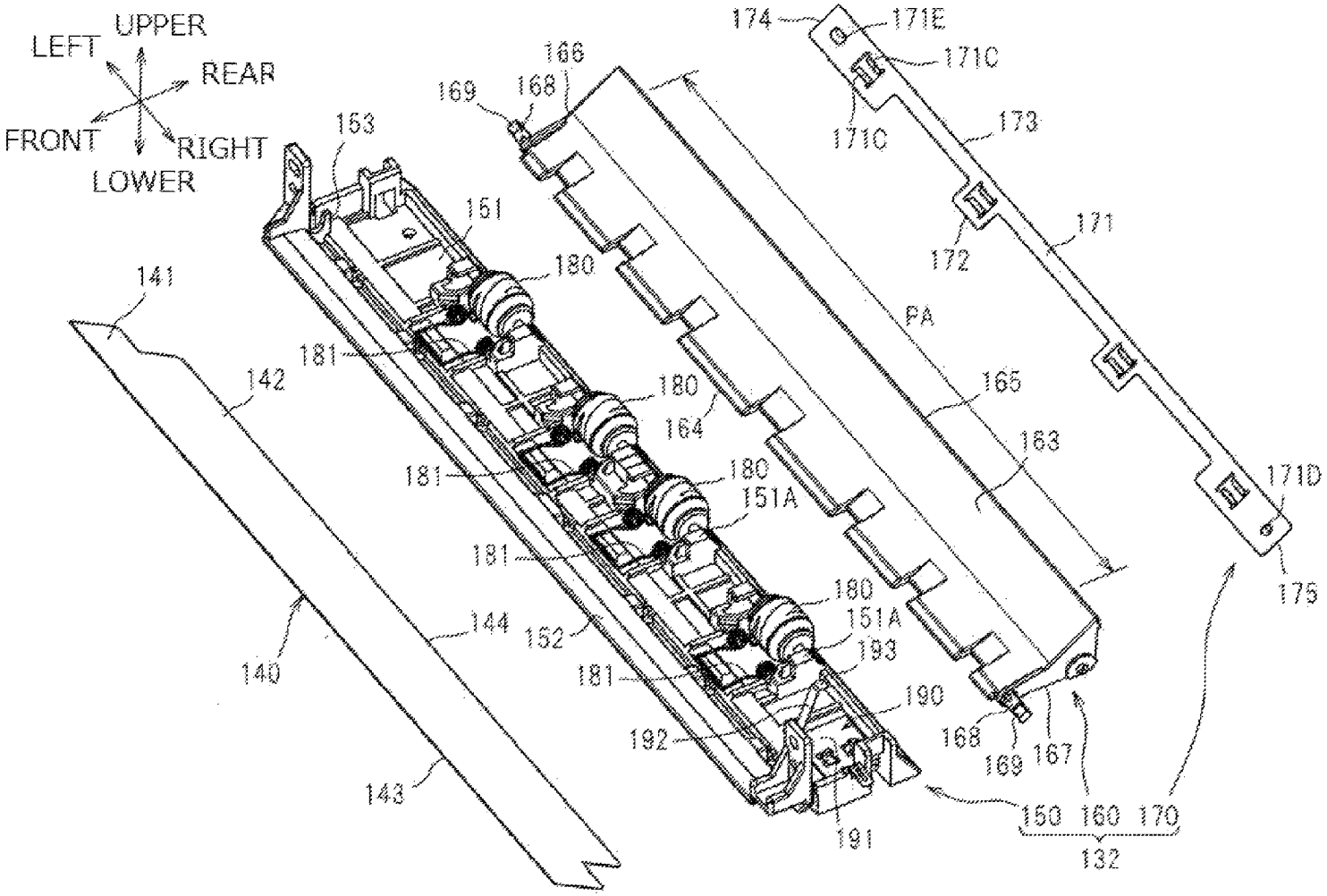
FIG. 4 is an exploded perspective view of a lower frame when seen from the upper.
Figure 5:
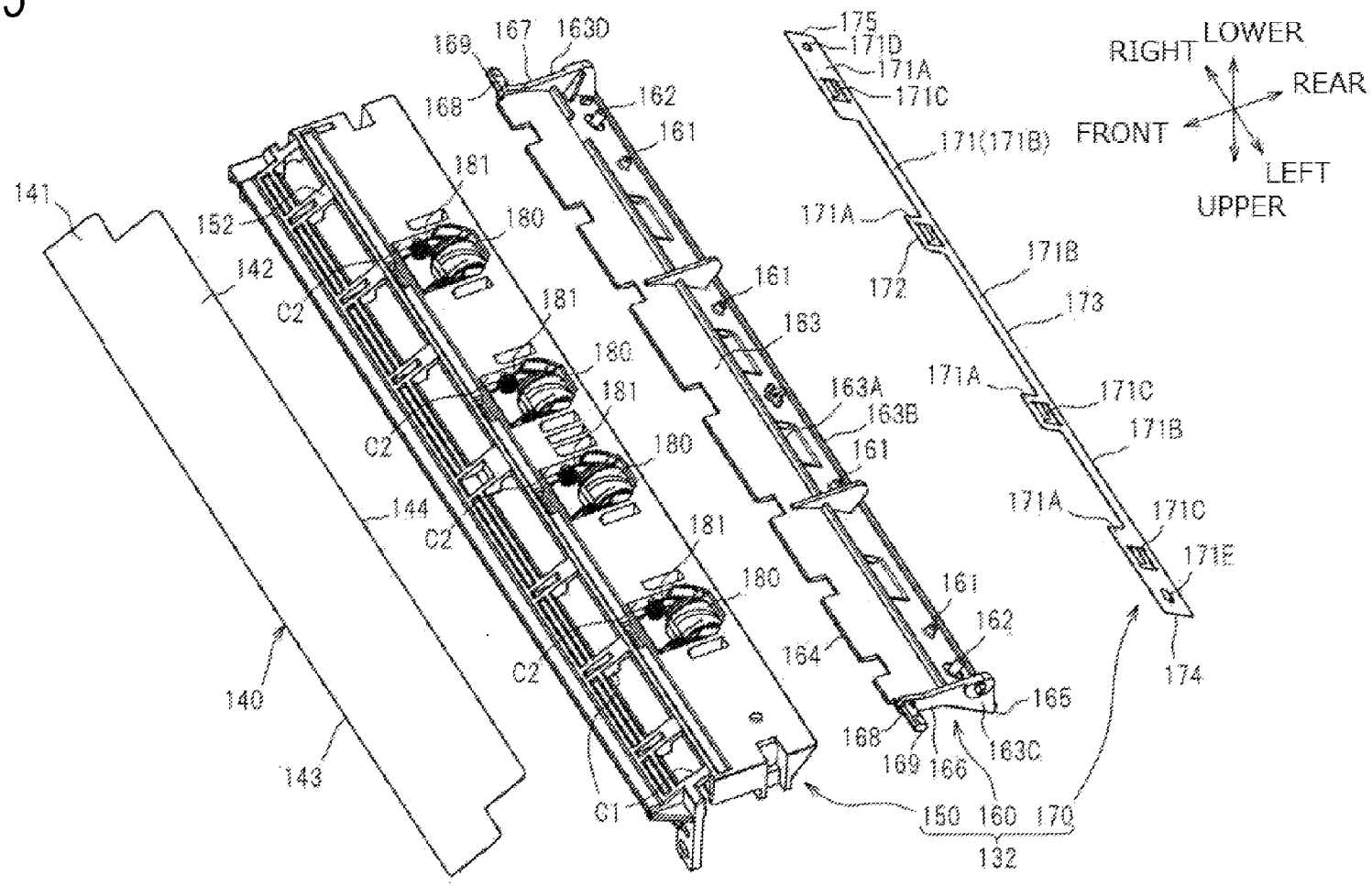
FIG. 5 is an exploded perspective view of the lower frame when seen from the lower.
Figure 6A:
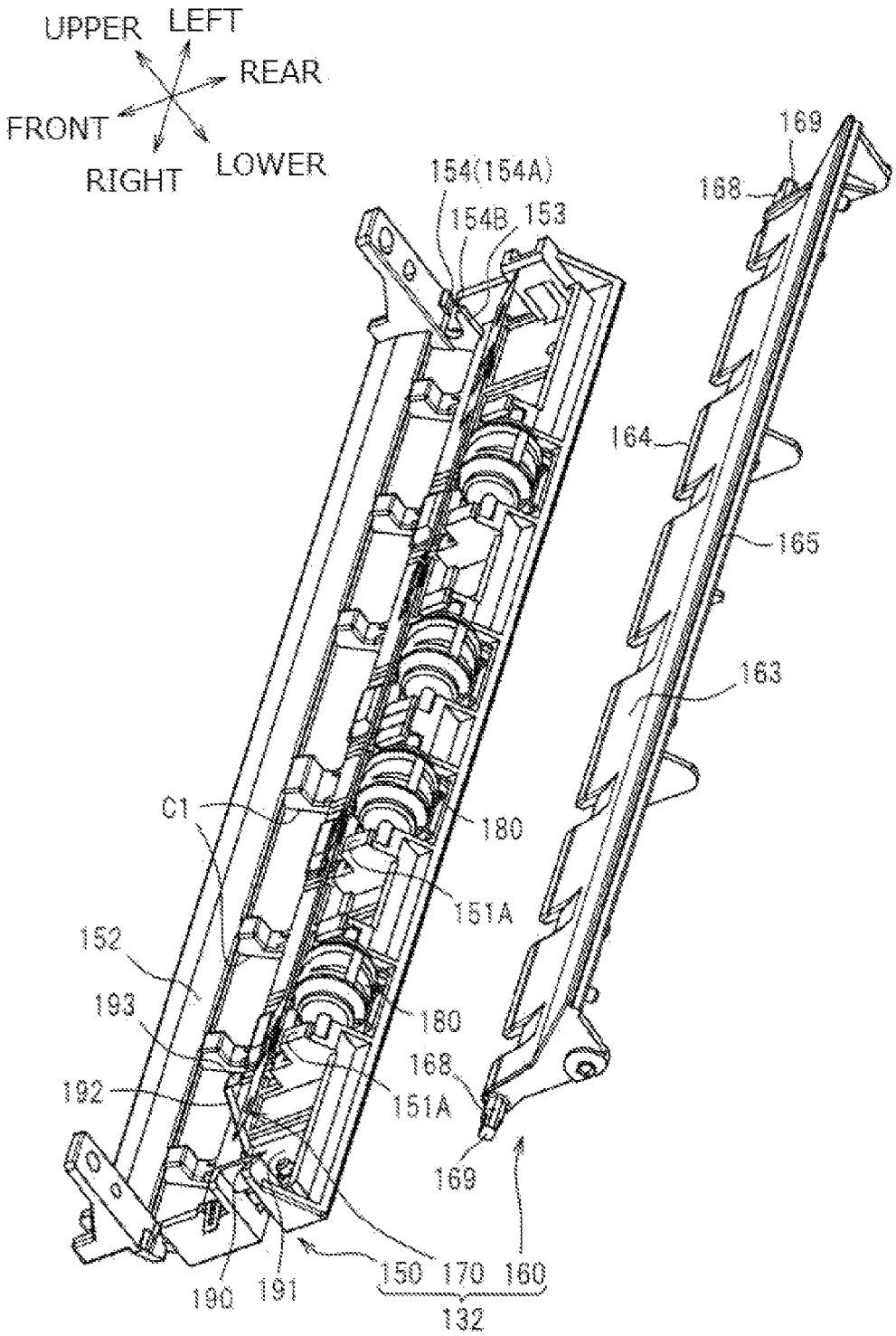
FIG. 6A is an exploded perspective view showing an engaging groove of an outer member and a retaining part of a lower guide member.
Figure 6B:
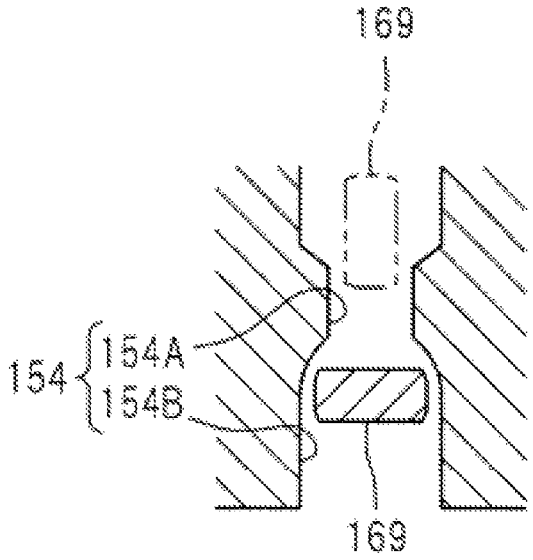
FIG. 6B is a schematic view showing a sequence of mounting the retaining part into the engaging groove.

As shown in FIGS. 4 to 6, the lower frame 132 includes an outer member 150 which configures an outer surface of the housing 130, a lower guide member 160 (an example of an insulating member) which is rotatably supported by the outer member 150, and a metal plate 170 (an example of a charge-removing member) which is provided on a lower side of the lower guide member 160.

The outer member 150 includes a plate-shaped part 151 which is long in the left-right direction, and an inclined part 152 which obliquely extends forwards and upwards from a front end portion of the plate-shaped part 151. A plurality of cleaning rollers 180 which are configured to contact the pressing roller 120 and remove paper powders and the like on the pressing roller 120 is rotatably provided to a rear end side of the plate-shaped part 151.

A plurality of springs 181 which urge the respective cleaning rollers 180 towards the pressing roller 120 are provided at a side of the plate-shaped part 151, which is at the front of the respective cleaning rollers 180. A plurality of holes C2 (refer to FIG. 5) which penetrate through the plate-shaped part 151 in the upper-lower direction, i.e., communicate between inner and outer sides of the plate-shaped part 151 (the housing 130) are formed on a lower side of the plate-shaped part 151 below the respective cleaning rollers 180 and the respective springs 181.

Each hole C2 is formed as a hole for removing die for forming a part 151A which supports a rotary shaft of each cleaning roller 180 (refer to FIG. 4 or 6).

The inclined part 152 is arranged to face the sensor S (refer to FIG. 3A), and a side of the inclined part 152 facing the plate-shaped part 151 is formed with a plurality of rectangular holes C1 which communicate between inner and outer sides of the inclined part 152 (the housing 130), at an interval in the left-right direction. Each hole C1 is a hole for making the fixing device 100 lightweight and is formed as a hole for suppressing interference between a front end edge 164 of the lower guide member 160 and the outer member 150 when attaching the lower guide member 160 to the outer member 150. An attachment structure of the lower guide member 160 and the outer member 150 will be described later.

The film 140 is adhered to the lower surface of the inclined part 152 so as to cover all the holes C1 (refer to FIG. 3A). That is, the film 140 is arranged between the sensor S and the holes C1 facing the sensor S, i.e., the holes C1 formed in the vicinity of the sensor S, so that it is possible to suppress the sensor S from being heated due to the heated air (the air whose temperature is not lowered) just after it passes through the holes C1 to thus flow from the housing 130 to the outside, compared to a structure where the film is not provided, for example.

The film 140 is a resin member which is elastically deformable, such as PET, and has a front part 141 which is wider than a rear part 141 in the left-right direction. The front part 141 (the part including a front end portion 143) of the film 140 is fixed to the inclined part 152 (the housing 130).

That is, the front end portion 143 (a downstream-side end portion in the mounting direction) of the film 140 is fixed to the housing 130. Thereby, when mounting the fixing device 100 to the apparatus body 10 at manufacturing of the color printer 1, for example, it is possible to suppress the front end portion 143 of the film 140 from interfering with the apparatus body 10 and thus being peeled off.

As shown in FIG. 3A, the rear end portion 144 of the film 140 is a free end in contact with a power supply cover 16, which configures the apparatus body 10, at a state where the fixing device 100 is mounted to the apparatus body 10. Here, the power supply cover 16 is a cover which covers a power supply substrate (not shown) and the air therein is exhausted to the outside by the exhaust fan 80 (refer to FIG. 1).

That is, the rear end portion 144 of the film 140 is in contact with the power supply cover 16, so that it is possible to favorably suppress the heat, which flows towards the sensor S through the holes C2 and the passage C3, by the film 140. In other words, in this illustrative embodiment, a flow path extending from the passage C3 to the sensor S is formed by a lower surface of the outer member 150 and an upper surface of the power supply cover 16, and the film 140 is provided to block the flow path. Thereby, it is possible to favorably suppress the heat, which flows towards the sensor S through the holes C2 and the passage C3, by the film 140.

A duct 17 which connects a rear space of the fixing device 100 and the exhaust fan 80 is provided at the rear of the power supply cover 16. A hole 17A is formed at an upper part of the duct 17. When the exhaust fan 80 is operated, the air in the fixing device 100 is suctioned into the duct 17 through the hole 17A of the duct 17, passes through the duct 17 and is then exhausted to the outside through the exhaust fan 80. Thereby, the heat which is exhausted to the outside of the fixing device 100 through the holes C2 and passage C3 and is blocked by the film 140 is also exhausted by the duct 17.

In the meantime, when mounting the fixing device 100 to the apparatus body 10, the rear end portion 144 of the film 140 contacts the duct 17 or the power supply cover 16. Since the film 140 is configured to be elastically deformable, it is possible to easily perform the mounting operation.

The metal plate 170 is a plate-shaped member for removing charge on the sheet P conveyed towards the fixing nip N1 and is arranged in the vicinity of a conveyance path 200 of the sheet P being conveyed towards the fixing nip N1 between the transfer nip N2 and the fixing nip N1. Specifically, as shown in FIGS. 4 to 6, the metal plate 170 mainly includes a main body part 171 and a front end edge 172, a rear end edge 173, a left end edge 174 and a right end edge 175, which are positioned at front, rear, left and right ends of the main body part 171, respectively.

The main body part 171 has a plate shape which is long in the left-right direction. The main body part 171 mainly includes a plurality of first portions 171A which are formed to have a predetermined width in the front-rear direction, and a plurality of second portions 171B which are formed to be narrower than the first portions 171A in the front-rear direction and connect the first portions 171A. Each of the first portions 171A is formed with a pair of front and rear engaging pieces 171C which are formed by cutting-up processing to be engaged with a first engaging protrusion 161 (described later), which is formed on a lower surface of the lower guide member 160, so as to sandwich the first engaging protrusion 161 in the front-rear direction.

The respective first portions 171A, which are arranged at the outermost sides in the left-right direction, are formed with positioning holes 171D, 171E for determining a position relative to the lower guide member 160 in the front-rear and left-right directions (described below). The positioning holes 171D, 171E are configured to engage with second engaging protrusions 162 formed on the lower surface of the lower guide member 160.

The left positioning hole 171E of the left and right positioning holes 171D, 171E is formed as a hole which is long in the left-right direction. Thereby, thermal expansion of the resin lower guide member 160 in the left-right direction (longitudinal direction) is absorbed.

The engaging pieces 171C and the positioning holes 171D, 171E are engaged with the respective engaging protrusions 161, 162 of the lower guide member 160, so that the metal plate 170 is fixed on the lower surface of the lower guide member 160. Thereby, it is possible to make the position of the metal plate 170 relative to the lower guide member 160 constant, so that it is possible to keep the charge-removing performance constant.

A right end portion of the metal plate 170 fixed to the lower guide member 160 contacts an intermediate earth member 190, which is provided at a right end portion of the outer member 150, at a state where the lower guide member 160 is attached to the outer member 150. Here, the intermediate earth member 190 includes a base part 191 which is fixed to an upper surface of the outer member 150, an arm part 192 which obliquely extends rearwards and upwards from a front end of the arm part 191, and a terminal part 193 which is bent rearwards from a leading end of the arm part 191, and is grounded through an earth member (not shown). Meanwhile, for showing convenience, in FIG. 6A, the terminal part 193 and the metal plate 170 are shown to be displaced.

The arm part 192 is configured to rotate (to be elastically deformable) relative to the base part 191. Thereby, even when the lower guide member 160 (described later) is rotated relative to the outer member 150, the arm part 192 rotates to thus keep the contact state of the metal plate 170 and the terminal part 193.

The lower guide member 160 is formed of non-conductive (insulating) resin. The lower guide member 160 mainly includes a guide main body part 163 having a plate shape, which is long in the left-right direction, and a front end edge 164, a rear end edge 165, a left end edge 166 and a right end edge 166, which are positioned at front, rear, left and right ends of the guide main body part 163, respectively. The front end edge 164 has a plurality of convex-concave shapes so as to correspond to the plurality of holes C1 of the outer member 150. The front end edge 164 of the most forward side is configured to enter the plurality of holes C1, respectively.

Figure 3B:
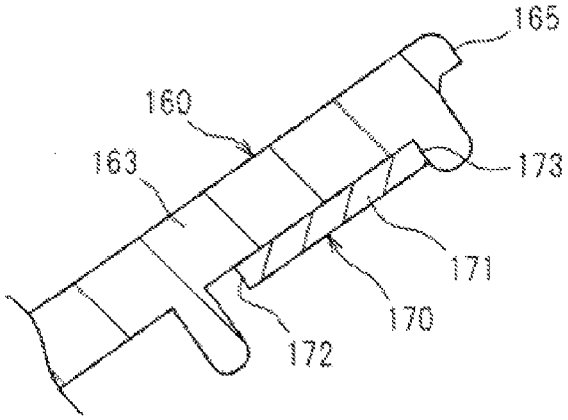
FIG. 3B is an enlarged sectional view showing a structure around a metal plate.

The guide main body part 163 has a long plate shape extending in the left-right direction (the longitudinal direction of the heating roller 110) and forms a part of the conveyance path 200 on its upper surface, as shown in FIGS. 3A and 3B. The guide main body part 163 is arranged between all the end edges 172 to 175 of the metal plate 170 and the conveyance path 200.

In other words, the guide main body part 163 is formed to cover all the end edges 172 to 175 of the metal plate 170, when seen from the conveyance path 200. Thereby, since the insulating guide main body part 163 is interposed between the conveyance path 200 and the end edges 172 to 175 of the metal plate 170, which is apt to attract charges, the charges collected on the sheet P passing through the conveyance path 200 are not rapidly removed at the metal plate 170, so that it is possible to improve an image quality.

Particularly, in this illustrative embodiment, the guide main body part 163 is also arranged between the main body part 171 of the metal plate 170 and the conveyance path 200. More specifically, the guide main body part 163 is formed to cover the entire upper surface (the surface facing the lower guide member 160) of the main body part 171 of the metal plate 170, when seen from the conveyance path 200.

That is, a portion of the guide main body part 163, which faces the metal plate 170, is not formed with a hole penetrating in the upper-lower direction, and the like, so that the metal plate 170 is suppressed from being exposed to the conveyance path 200. Thereby, it is possible to further suppress the charges collected on the sheet P from being rapidly removed at the metal plate 170.

Also, all the end edges 164 to 167 of the lower guide member 160 are formed to more protrude outwards than all the end edges 172 to 175 of the metal plate 170 (only the front and rear end edges are shown). Thereby, since it is possible to lengthen a creeping distance from the sheet P passing through the conveyance path 200 to the end edges 172 to 175 of the metal plate 170, it is possible to further suppress the charges collected on the sheet P from being rapidly removed at the end edges 172 to 175 of the metal plate 170.

As shown in FIG. 4, a rear side (a side facing the metal plate 170) of the guide main body part 163 is continuously formed throughout the entirety of a passing area PA of the sheet P having a maximum width. Thereby, it is possible to further suppress the charges collected on the sheet P from being rapidly removed at the metal plate 170, compared to a configuration (a configuration where the guide main body part is formed with a hole or notch) where the guide main body part is intermittently formed throughout the entirety of the passing area of the sheet having a maximum width, for example.

Also, as shown in FIG. 5, the guide main body part 163 of the lower guide member 160 is formed with a front rib 163A, a rear rib 163B, a left rib 163C and a right rib 163D (an example of a protrusion). The respective ribs 163A to 163D protrude downwards (towards the metal plate 170) from the guide main body part 163 and are arranged to surround the metal plate 170.

In other words, all the end edges 172 to 175 of the metal plate 170 face the respective ribs 163A to 163D. Thereby, the creeping distance from the conveyance path 200 to the respective end edges 172 to 175 of the metal plate 170 can be lengthened by the respective ribs 163A to 163D. Therefore, it is possible to further suppress the charges collected on the sheet P from being rapidly removed at the end edges 172 to 175 of the metal plate 170.

As shown in FIGS. 4 to 6, both left and right sides of a front end portion of the guide main body part 163 are formed with rotary shaft parts 168 protruding outwards in the left-right direction. The respective rotary shaft parts 168 are rotatably supported to respective shaft support parts 153 (only one is shown) which are provided to both left and right ends of the front side part of the outer member 150. The respective rotary shaft parts 168 are supported to the respective shaft support parts 153, so that the guide main body part 163 can swing upwards and downwards at the rear end edge 165 thereof (an end portion facing the fixing nip N1) relative to the outer member 150.

Thereby, even though the sheet P is bent downwards at an arrival of the sheet P at the fixing nip N1 of the fixing device 100, it is possible to absorb the bending of the sheet P by the swinging of the guide main body part 163.

Also, a tip end portion of each rotary shaft part 168 is formed with a retaining part 169 having a rectangular shape, when seen from the section. In the meantime, engaging grooves 154 (only one is shown) which are engaged with the retaining parts 169 are formed at outer sides of the respective shaft support parts 153 of the outer member 150 in the left-right direction.

The engaging groove 154 includes a first groove portion 154A having a width of the front-rear direction larger than a width of a width direction of the rectangular retaining part 169 and smaller than a width of a longitudinal direction thereof, and a second groove portion 154B arranged below the first groove portion 154A and having a width larger than the width of the longitudinal direction of the retaining part 169. When attaching the lower guide member 160 to the outer member 150, the retaining parts 169 are vertically inserted into the first groove portions 154A along the longitudinal direction thereof When the retaining parts are introduced into the second groove portions 154B, the retaining parts are rotated to thus change the direction to the horizontal direction. Thereby, the retaining parts 169 are prevented from being separated from the first groove portions 154A having a narrower width.

In the meantime, at the above-described attachment operation, the front end edge 164 of the lower guide member 160 is configured to enter and swing in the respective holes C1 of the outer member 150. That is, as described above, the interference between the front end edge 164 of the lower guide member 160 and the outer member 150 can be suppressed by the respective holes C1.

According to the above illustrative embodiment, following effects can be obtained in addition to the above effects.

Since the insulating member for suppressing the charges collected on the sheet P passing through the conveyance path 200 from being rapidly removed at the metal plate 170 is configured as the lower guide member 160 forming a part of the conveyance path 200, it is possible to reduce the number of parts, compared to a structure where the member forming the conveyance path and the insulating member are separately provided.

While the present invention has been shown and described with reference to certain illustrative embodiments thereof, it will be understood by those skilled in the art that various changes in form and details may be made therein without departing from the spirit and scope of the invention as defined by the appended claims.

In the above illustrative embodiment, the metal plate 170 has been exemplified as the charge-removing member. However, the invention is not limited thereto. For example, the charge-removing member may be a metallic rod-shaped member.

In the above illustrative embodiment, the lower guide member 160 which forms a part of the conveyance path has been exemplified as the insulating member. However, the invention is not limited thereto. For example, a member which does not form the conveyance path may be adopted as the insulating member.

In the above illustrative embodiment, the entire charge-removing member (metal plate 170) is covered by the insulating member (the lower guide member 160). However, the invention is not limited thereto. For example, the main body part may be exposed to the conveyance path if all the end edges of the charge-removing member are covered by the insulating member.

In the above illustrative embodiment, the ribs 163A to 163D have been exemplified as the protrusion. However, the invention is not limited thereto. For example, the protrusion may be a step.

In the above illustrative embodiment, the insulating member (the lower guide member 160) is continuously formed throughout the entire passing area PA of the sheet P having a maximum width. However, the invention is not limited thereto. For example, the insulating member may be formed with a hole and the like at a part corresponding to the passing area PA of the sheet P having a maximum width.

In the above illustrative embodiment, the photosensitive drum 53 has been exemplified as the photosensitive member. However, the invention is not limited thereto. For example, the photosensitive member may be a belt-shaped photosensitive member.

In the above illustrative embodiment, the transfer unit 70 having the conveyance belt 73 and the transfer rollers 74 has been exemplified as the transferring member. However, the invention is not limited thereto. For example, for a monochrome printer, the transferring member may be a transfer roller, a conductive brush or conductive plate spring to which a transfer bias is applied, and the like.

In the above illustrative embodiment, the fixing device 100 is removably mounted to the apparatus body 10 in the front-rear direction. However, the invention is not limited thereto. For example, the fixing device may be removably mounted in the left-right direction or upper-lower direction.

In the above illustrative embodiment, the film 140 is made of resin. However, the invention is not limited thereto. For example, the film may be made of metal.

In the above illustrative embodiment, the heating roller 110 has been exemplified as the first fixing member. However, the invention is not limited thereto. For example, the first fixing member may be a plate-shaped nip member, a cylindrical fixing film and the like.

In the above illustrative embodiment, the pressing roller 120 has been exemplified as the second fixing member. However, the invention is not limited thereto. For example, the second fixing member may be a belt-shaped pressing member, a plate-shaped pressing member which is not rotated and the like. Also, the first fixing member may be the pressing roller and the second fixing member may be the heating roller.

In the above illustrative embodiment, the invention is applied to the color printer 1. However, the invention is not limited thereto. For example, the invention may be also applied to the other image forming apparatuses, such as copier and complex machine.

In the above illustrative embodiment, the sheet P such as cardboard, postcard, thin paper and the like is adopted as an example of the recording sheet. However, the invention is not limited thereto. For example, the recording sheet may be an OHP sheet and the like.

What is claimed is:

1. An image forming apparatus comprising:

a photosensitive member having a surface, on which a developer image is configured to be formed;

a transferring member arranged to face the photosensitive member and configured to transfer the developer image formed on the surface of the photosensitive member to a recording sheet at a transfer nip formed between the photosensitive member and the transferring member; and a fixing device including a first fixing member and a second fixing member, and configured to heat-fix the developer image transferred on the recording sheet from the photosensitive member at a fixing nip formed between the first fixing member and the second fixing member;

wherein the fixing device further includes:

a charge-removing member arranged along a conveyance path of the recording sheet conveyed from the transfer nip to the fixing nip in a conveying direction, the charge-removing member including:

a main body part;

an upstream end edge positioned at an edge of the main body part at an upstream side of the conveying direction;

a downstream end edge positioned at an edge of the main body part at a downstream side of the conveying direction; and side end edges positioned at edges of the main body part at both sides in a direction perpendicular to the conveying direction; and an insulating member arranged between the conveyance path, which is downstream of the transfer nip and upstream of the fixing nip, and at least an entirety of the upstream end edge and the downstream end edge of the charge-removing member.

2. The image forming apparatus according to claim 1, wherein the insulating member is arranged between the main body part and the conveyance path.

3. The image forming apparatus according to claim 1, wherein an end edge of the insulating member protrudes further outwards than the upstream and downstream end edges of the charge-removing member.

4. The image forming apparatus according to claim 3, wherein the insulating member is provided with a protrusion protruding towards the charge-removing member, and wherein the upstream and downstream end edges of the charge-removing member face the protrusion.

5. The image forming apparatus according to claim 1, wherein the insulating member is formed to cover an entire surface of the charge-removing member, which faces the insulating member.

6. The image forming apparatus according to claim 1, wherein a surface of the insulating member, which faces the conveyance path, forms at least a part of the conveyance path.

7. The image forming apparatus according to claim 1, wherein the insulating member extends in a longitudinal direction of the first fixing member and is continuously formed over an entire passing area of a recording sheet having a maximum width.

8. The image forming apparatus according to claim 1, wherein the charge-removing member is fixed to the insulating member.

9. The image forming apparatus according to claim 1, wherein the insulating member includes an end portion at a side of the fixing nip, and the end portion is configured to be swingable.

10. The image forming apparatus according to claim 1, wherein the charge-removing member is a plate-shape member.

11. The image forming apparatus according to claim 1, wherein the insulating member is arranged between the conveying path and entirety of the upstream end edge, the downstream end edge and the side end edges of the charge-removing member.

12. A fixing device comprising:

a first fixing member;

a second fixing member, wherein the fixing device is configured to heat-fix a developer image on a recording sheet at a fixing nip formed between the first fixing member and the second fixing member;

a charge-removing member arranged upstream of the fixing nip in a conveyance direction of the recording sheet and along a conveyance path of the recording sheet conveyed towards the fixing nip in a conveying direction, the charge-removing member including a main body part;

an upstream end edge positioned at an edge of the main body part at an upstream side of the conveying direction;

a downstream end edge positioned at an edge of the main body part at a downstream side of the conveying direction; and side end edges positioned at edges of the main body part at both sides in a direction perpendicular to the conveying direction; and an insulating member arranged between the conveyance path, which is downstream of a transfer nip at which a developer image is transferred to the recording sheet and upstream of the fixing nip, and at least an entirety of the upstream end edge and the downstream end edge of the charge-removing member.

13. The fixing device according to claim 12, wherein the insulating member is arranged between the main body part and the conveyance path.

14. The fixing device according to claim 12, wherein an end edge of the insulating member protrudes further outwards than the upstream and downstream end edges of the charge-removing member.

15. The fixing device according to claim 14, wherein the insulating member is provided with a protrusion protruding towards the charge-removing member, and wherein the upstream and downstream end edges of the charge-removing member face the protrusion.

16. The fixing device according to claim 12, wherein the insulating member is formed to cover an entire surface of the charge-removing member, which faces the insulating member.

17. The fixing device according to claim 12, wherein a surface of the insulating member, which faces the conveyance path, forms at least a part of the conveyance path.

18. The fixing device according to claim 12, wherein the insulating member extends in a longitudinal direction of the first fixing member and is continuously formed over an entire passing area of a recording sheet having a maximum width.

19. The fixing device according to claim 12, wherein the charge-removing member is fixed to the insulating member.

20. The fixing device according to claim 12, wherein the insulating member includes an end portion at a side of the fixing nip, and the end portion is configured to be swingable.

21. The fixing device according to claim 12, wherein the charge-removing member is a plate-shape member.

* * * * *